United States Patent [19]

Shaffer et al.

[11] 4,382,754

[45] May 10, 1983

[54] SCROLL-TYPE, POSITIVE FLUID DISPLACEMENT APPARATUS WITH DIVERSE CLEARANCES BETWEEN SCROLL ELEMENTS

[75] Inventors: Robert W. Shaffer; Jan R. Acker, both of Campbellsville, Ky.

[73] Assignee: Ingersoll-Rand Company, Woodcliff Lake, N.J.

[21] Appl. No.: 208,498

[22] Filed: Nov. 20, 1980

[51] Int. Cl.[3] ..... F01C 1/02

[52] U.S. Cl. ..... 418/55; 418/83

[58] Field of Search ..... 418/55, 57, 59, 83

[56] References Cited

U.S. PATENT DOCUMENTS

| | | | |
|---|---|---|---|
| 2,324,168 | 7/1943 | Montelius | 418/55 |
| 3,802,809 | 4/1974 | Vulliez | 418/55 |
| 3,874,827 | 4/1975 | Young | 418/55 |
| 4,082,484 | 4/1978 | McCullough | 418/57 |

FOREIGN PATENT DOCUMENTS

| | | | |
|---|---|---|---|
| 1165435 | 10/1969 | United Kingdom | 418/55 |

*Primary Examiner*—John J. Vrablik

*Attorney, Agent, or Firm*—B. J. Murphy

[57] ABSTRACT

The invention comprises a positive fluid displacement apparatus of the scroll-type described as a fluid compressor in the exemplary embodiment. The embodiment has single fixed and movable scroll elements in which the latter describes orbital movement relative to the former to form variable volume pockets therebetween which move from an inlet to an outlet. To accommodate for a difference in thermal expansion between the innermost and outermost zones of the apparatus, the scroll elements are formed with varying thicknesses along the lengths thereof. Accordingly, centrally of the apparatus, whereat an exhaust port is formed, scroll element thicknesses are greatest, the compressed fluid is most dense, and the thermal expansion is least, the elements define close, substantially sealing minimum clearances of a given measure. In the outermost confines of the apparatus, whereat an inlet port is formed, scroll element thicknesses are least, the fluid is less dense, and the thermal expansion is greatest, the elements define similar minimum clearances, albeit of greater than the aforesaid given measure.

9 Claims, 2 Drawing Figures

Figure 1:
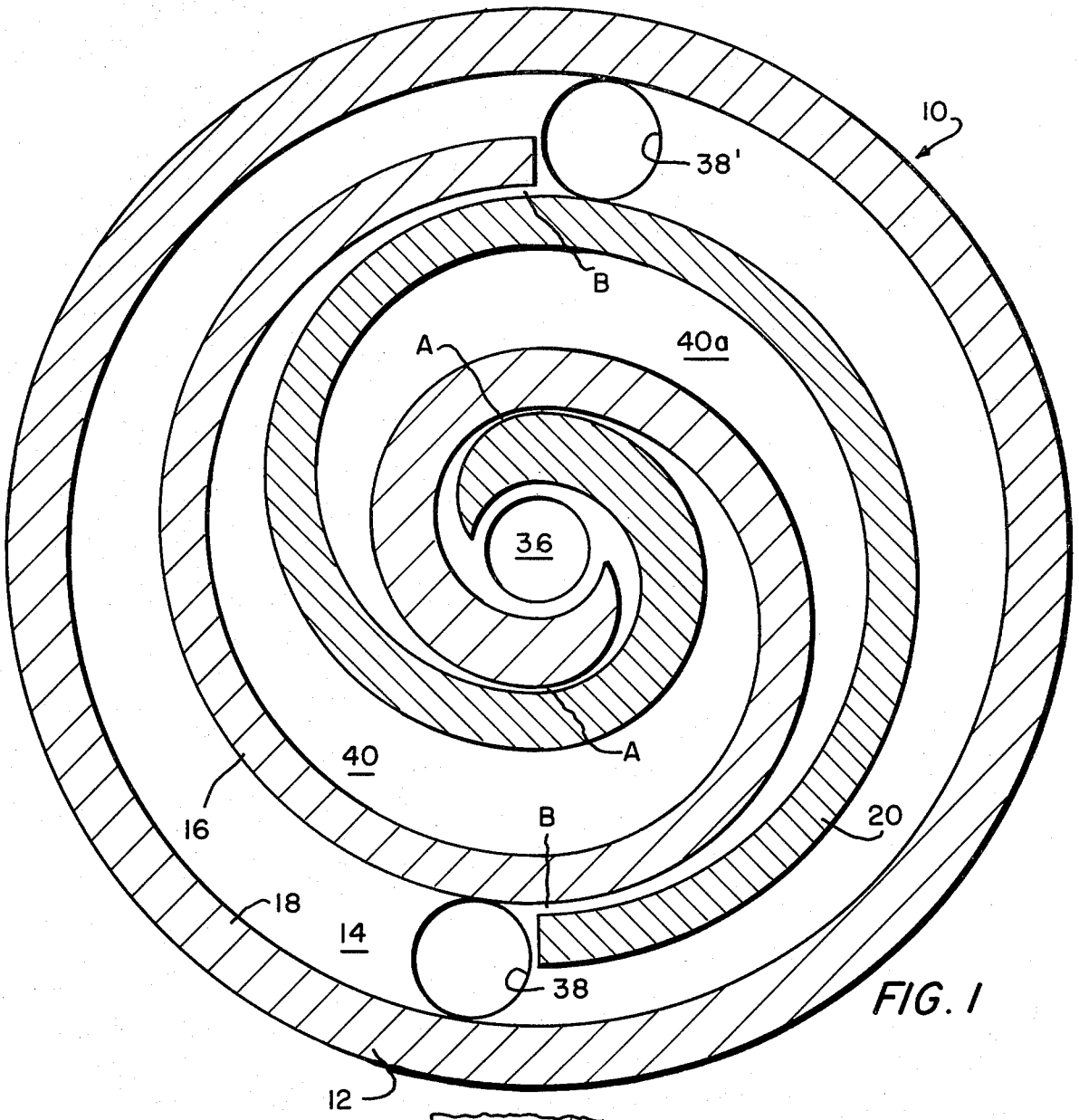

SCROLL-TYPE, POSITIVE FLUID DISPLACEMENT APPARATUS WITH DIVERSE CLEARANCES BETWEEN SCROLL ELEMENTS

This invention pertains to fluid displacement apparatus and more particularly to apparatus, for handling fluids to compress, expand or pump same, of the "scroll" type. Such apparatus comprises the use of scroll members which make moving and close, substantially sealing, minimum clearances therebetween to define moving isolated volumes, called "pockets", which carry the fluid to be handled from a first zone in the apparatus, whereat a fluid inlet is provided, to a second zone in the apparatus, whereat a fluid outlet is provided. The relationships which define these pockets formed between scroll members are of two types: the aforesaid minimum clearances between spiral cylindrical surfaces, and area contacts between plane surfaces. The volume of a sealed pocket changes as it moves. At any one instant of time, there will be at least one sealed pocket. When there are several sealed pockets at one instant of time, they will have different volumes, and in the case of a compressor or expander, they will also have different pressures.

Devices of this type, generally referred to as "scroll" pumps, compressors and engines, have two or more interfitting spiroidal or involute spiral elements of like pitch which are mounted on separate end plates. These spirals are angularly and radially offset to close upon each other. The pockets define fluid volumes which vary with relative orbiting of the spiral centers while maintaining the same relative spiral angular orientation. As the close, minimum clearances shift along the scroll surfaces, the pockets thus formed experience a change in volume. The resulting zones of lowest and highest pressures are connected to fluid ports, as aforesaid.

With respect to positive fluid displacement gas compressors (or expanders), of high capacity and/or high pressure capability, discharge (or inlet) temperatures tend to be inordinately elevated.

Also, a scroll compressor (or expander) is a controlled leakage machine. The orbiting scroll, as noted, does not seal against the fixed scroll as it orbits, but rather maintains some positive, minimum clearance. This clearance determines the performance of the compressor since it controls the leakage of compressed air.

The amount of clearance required is determined by machining tolerances and thermal expansion. Accordingly, in prior art machines of this type, equal clearance is provided from inlet to discharge, based on the magnitude of the thermal expansion at the outer wraps; thermal expansion is outward from the center.

Within the outermost confines of the apparatus where the thermal expansion is the greatest, and the fluid is relatively thin, the uniform clearance is quite acceptable. However, centrally of the apparatus where the thermal expansion is less pronounced and the fluid is particularly dense, the uniform clearance thereat is not acceptable and causes inefficient fluid loss or leakage.

It is, therefore, an object of this invention to set forth an improved apparatus which does not have this fluid loss disadvantage. It is also an object of this invention to set forth a scroll-shaped fluid element useful in an apparatus of the type noted to substantially eliminate the aforesaid losses. It is also an object of this invention to set forth an improved, scroll-type, positive fluid displacement apparatus, having means defining a circular and walled, fluid-working chamber, said chamber having a radial center and an outer peripheral area circumscribing said center, a pair of scroll-shaped, fluid-working elements within said chamber, and extending from an adjacency to said radial center into said peripheral area, a first port opening into, and substantially centrally of, said chamber, a second port opening into said chamber radially outwardly-spaced from said first port, and means mounting at least one of said scroll-shaped, fluid-working elements for movement of the latter in an orbit, within said chamber, relative to, and interfittingly with, the other of said elements, to effect moving and close, substantially sealing, minimum clearances, between said elements, which define inter-element, walled, variable-volume pockets which, during orbit of said one element, close off, and move progressively and circularly, from one of said ports toward the second of said ports for opening of said pockets onto, and for communication of said pockets with, said second port, wherein the improvement is comprised by: said elements having prescribed configurations which cooperate with said mounting means to cause said minimum clearances, between said elements, to be of a given clearance therebetween in said peripheral area of said chamber, of a clearance other then said given clearance in adjacency to said radial center, and of a family of clearances, which differ from said given and other clearances, intermediate said given and other clearances.

It is also an object of this invention to set forth, for use in a scroll-type, positive fluid displacement apparatus which has (a) a curved and walled, fluid-working chamber (b) a first port opening into, and substantially centrally of, said chamber, (c) a second port opening into said chamber radially outwardly-spaced from said first port, and (d) means for mounting at least one element of a pair of scroll-shaped, fluid-working elements for movement of such one element in an orbit within said chamber, relative to, and interfittingly with, the other element of such pair, to effect moving and close, substantially sealing, minimum clearances, between such elements, which define inter-element, walled, variable-volume pockets which, during orbit of such one element, close off, and move progressively and circularly, from one of said ports toward the second of said ports for opening of said pockets onto, and for communication of said pockets with, said second port, a scroll-shaped, fluid-working element, comprising: a plate; said plate having a scroll-shaped component joined thereto and extending substantially normal therefrom; said component defining substantially a spiral extending circularly and outwardly from an initial radius; and wherein said component has a diverse thickness along the spiral length thereof.

Figure 2:
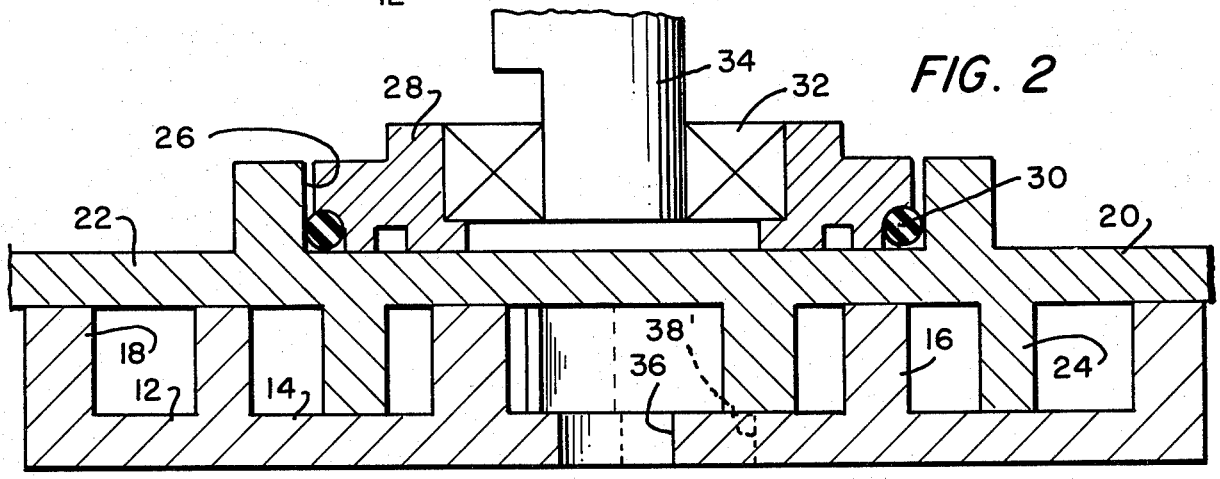

Further objects of this invention, as well as the novel features thereof, will become more apparent by reference to the following description taken in conjunction with the accompanying figures in which:

FIG. 1 is a cross-sectional view of an embodiment of the invention taken on a plane normal to the axis of the apparatus; and FIG. 2 is a cross-sectional view of the embodiment of FIG. 1 taken through a plane common with the axis of the apparatus.

As shown in the figures, an embodiment of an improved, scroll-type positive fluid displacement apparatus 10, according to the invention, comprises a fixed scroll assembly 12 having a base plate 14 and a scroll-shaped element 16 rising therefrom, as well as a peripheral wall 18. A coacting, movable, scroll assembly 20 also having a plate 22, from which extends another scroll-type element 24, interfits with the fixed scroll assembly 12. The plate 22 makes a sliding, sealing closure upon the peripheral wall 18 of the fixed base plate 14.

The movable scroll assembly 20 has a circular recess 26 which receives a bearing housing 28 and a seal 30; in turn, a bearing 32 and an offset crank 34 are assembled in the housing 28. The plate 14 of the fixed scroll assembly 12 has a central port 36 for high-pressure fluid, and a pair of outlying ports 38 and 38' for low-pressure fluid.

The nature and functioning of scroll-type apparatus of this type are well known from the prior art. Typical of the latter is the Scroll-Type Two Stage Positive Fluid-Displacement Apparatus With Intercooler, disclosed in U.S. Pat. No. 4,141,677, issued on Feb. 27, 1979, to H. William Weaver and Robert W. Shaffer. Such apparatus, as thus far described, being generally understood, it is not necessary to detail the operation thereof here. It should be sufficient to explain briefly, with reference to the exemplary embodiment, its operation as a fluid compressor.

In use of the apparatus 10 as a compressor, the movable scroll element 24 describes an orbit, on being driven by the offset crank 34, and makes close, substantially-sealing clearances A and B with the fixed scroll element 16. As a consequence, there are defined a plurality of pockets 40 and 40*a* which move progressively from the outlying portion of the apparatus 10 into the center whereat the compressed fluid exits through the central port 36. In that thermal expansion is outward from the center, a common or uniform clearance between the adjacent, side flanks of the fixed and movable scroll elements 16 and 24 is acceptable outwardly, for clearances B, but not inwardly for clearances A. According to our invention, and as shown in FIG. 1 in exaggerated fashion, the clearances A, centrally of the apparatus 10, are smaller than the outlying clearances B, and therebetween in a family of clearances which differ from clearances A and B. This is done by making the scroll elements 16 and 24 thicker inwardly than outwardly. Accordingly thermal expansion causes a first relative closure of the flanks, at clearances B, and a second, different, relative closure at clearances A. There is less thermal expansion in the center, so that the smaller clearances A will inhibit the loss or leakage of compressed fluid.

As it is a more practical approach, from a manufacturing point of view, the scroll elements 16 and 24 are mirror images of each other, and each has a progressively and uniformly increasing thickness toward the center. Also, in a further alternative arrangement, the diverse thickness could be defined by one thickness-step, or a plurality of discrete thickness-steps.

While we have described our invention in connection with a specific embodiment thereof, it is to be clearly understood that this is done only by way of example, and not as a limitation to the scope of our invention as set forth in the objects thereof and in the appended claims.

We claim:

1. An improved, scroll-type, positive fluid displacement apparatus, having means defining a curved and walled, fluid-working chamber, said chamber having a radial center and an outer peripheral area circumscribing said center, a pair of scroll-shaped, fluid-working elements within said chamber and extending from an adjacency to said radial center into said peripheral area, a first port opening into, and substantially centrally of, said chamber, a second port opening into said chamber radially outwardly-spaced from said first port, and means mounting at least one of said scroll-shaped, fluid-working elements for movement of the latter in an orbit, within said chamber, relative to, and inter-fittingly with, the other of said elements, to effect moving and close, substantially sealing, minimum clearances, between said elements, which define inter-element, walled, variable-volume pockets which, during orbit of said one element, close off, and move progressively and circularly, from one of said ports toward the second of said ports for opening of said pockets onto, and for communication of said pockets with, said second port, wherein the improvement is comprised by:

said elements having prescribed configurations which cooperate with said mounting means to cause said minimum clearances, between said elements, to be of a given clearance therebetween in said peripheral area of said chamber, of a clearance other than said given clearance in adjacency to said radial center, and of a family of clearances, which differ from said given and other clearances, intermediate said given and other clearances.

2. An improved, scroll-type, positive fluid displacement apparatus, according to claim 1, wherein:

each of said elements has a diverse thickness along the length thereof.

3. An improved, scroll-type, positive fluid displacement apparatus, according to claim 1, wherein:

each of said elements has a uniformly varying thickness along the length thereof.

4. An improved, scroll-type, positive fluid displacement apparatus, according to claim 1, wherein:

at least one of said elements has a diverse thickness along the length thereof.

5. An improved, scroll-type, positive fluid displacement apparatus, according to claim 1, wherein:

at least one of said elements has a uniformly varying thickness along the length thereof.

6. An improved, scroll-type, positive fluid displacement apparatus, according to claim 1, wherein:

at least one of said elements has a given thickness at one end thereof which is most adjacent to one of said ports, and a thickness other than said given thickness at the opposite end thereof which is most adjacent to the other of said ports.

7. An improved, scroll-type, positive fluid displacement apparatus, according to claim 1, wherein:

each of said elements has a given thickness at one end thereof which is most adjacent to one of said ports, and a thickness other than said given thickness at the opposite end thereof which is most adjacent to the other of said ports.

8. An improved, scroll-type, positive fluid displacement apparatus, according to claim 7, wherein:

said one port is a high-pressure port; and said given thickness is greater than said other thickness.

9. An improved, scroll-type, positive fluid displacement apparatus, according to claim 7, wherein:

said first port is a high-pressure port;

said one ends, of each of said elements, are most adjacent to said first port; and said given thickness is greater than said other thickness.

* * * * *